United States Patent [19]

Widén et al.

[11] Patent Number: 4,507,944

[45] Date of Patent: Apr. 2, 1985

[54] CYLINDER LOCK COMBINATION, A LOCK CYLINDER AND A KEY FOR SUCH A COMBINATION

[75] Inventors: Bo Widén, Torshälla; Björn Rubensson, Eskilstuna, both of Sweden

[73] Assignee: GKN-Stenman AB, Eskilstuna, Sweden

[21] Appl. No.: 336,383

[22] PCT Filed: May 19, 1981

[86] PCT No.: PCT/SE81/00150

§ 371 Date: Dec. 30, 1981

§ 102(e) Date: Dec. 30, 1981

[87] PCT Pub. No.: WO81/03355

PCT Pub. Date: Nov. 26, 1981

[30] Foreign Application Priority Data

May 20, 1980 [SE] Sweden ..... 8003772

[51] Int. Cl.[3] ..... E05B 47/00

[52] U.S. Cl. ..... 70/276; 70/278; 70/413

[58] Field of Search ..... 70/276, 277, 278, 413; 335/207, 206; 338/32 R, 287, 308

[56] References Cited

U.S. PATENT DOCUMENTS

| | | | |
|---|---|---|---|
| 4,287,733 | 9/1981 | Gomez-Oleo | 70/276 |
| 4,331,013 | 5/1982 | Jaulmes | 70/278 |
| 4,399,673 | 8/1983 | Gotanda | 70/276 |
| 4,414,831 | 11/1983 | Perkut | 70/276 |

*Primary Examiner*—Robert L. Wolfe

*Attorney, Agent, or Firm*—Sughrue, Mion, Zinn, Macpeak and Seas

[57] ABSTRACT

A cylinder lock-key combination includes a cylinder housing (1) having arranged therein a rotatable cylinder plug (2) having a slot (3) for a key (8). Arranged on the spine of the key is coded information in the form of regions (8*a*, 8*b*) of mutually different magnetic permeability. When the key moves relative to the housing these regions cause variations in a magnetic flux generated by a magnetic body (5*k*) and passing the key slot (3). A differential field plate (5) arranged in the housing and incorporated in an electric circuit, which also incorporates a bridge coupling, is arranged to convert said magnetic flux variations to momentary changes in resistance in the electric circuit, causing the bridge coupling to become unbalanced so that an electric pulse train corresponding to the coded information is generated in the circuit. This pulse train is sensed and evaluated by means, for example, of a data processing device. The invention also relates to a cylinder lock and a key for said combination.

10 Claims, 5 Drawing Figures

CYLINDER LOCK COMBINATION, A LOCK CYLINDER AND A KEY FOR SUCH A COMBINATION

FIELD OF THE INVENTION

The present invention concerns a cylinder lock-key combination comprising a cylinder housing in which there is arranged a rotatable cylinder plug having a key slot and an electronic evaluating circuit for establishing proper actuation of the cylinder, whereat the key constitutes a carrier of coded information which can be read-off through a sensing means arranged in the cylinder housing and/or the cylinder plug and connected to the electronic circuit.

STATE OF THE ART

A comparatively complicated system of this kind is described in Swedish Patent Application No. 7902397-4 (Bauer Kaba), in which for the purpose of identifying the key, the part thereof which is inserted into the cylinder is provided with a magnetically passive and inductively readable information carrier. Thus, in this known system the key is arranged to generate induction currents when inserted into the lock cylinder, and the magnitude and/or sense of the induction currents is, or are, detected by a read-out head arranged in the lock cylinder and provided to this end with a read-out coil which is activated by means of an alternating current. According to a preferred embodiment the read-out head in the lock cylinder and the code information on the key are so constructed and arranged relative to one another that during relative movement between the key and the lock cylinder there are generated two timing signals representing the direction of movement and the speed of movement, and an identification information signal. German Open-to-public-print No. 23 25 566 (Zeiss Ikon) describes a similar system.

A system of this kind based on information signals generated by means of electric induction requires the provision of a large number of complicated components incorporating an evaluation current circuit in order to achieve the accuracy required. The induction currents generated when the key is slowly inserted into the lock are particularly weak, and to eliminate the potential risk of erroneous evaluation the components of the circuit in question must be constructed with particular precision. As a result hereof, the lock as a whole is also expensive and, moreover, is sensitive to different forms of actuation.

In the lock arrangement described and illustrated in the German Open-to-public-print No. 25 46 542 (Zeiss Ikon), the key is instead provided with magnetic information means, whereat the sensing or read-out means of the cylinder lock comprises a Hall generator which is actuated by the magnetic field generated by the code, the field lines of said magnetic field extending both parallel with and perpendicularly to the longitudinal axis of the key. In order to detect the information correctly there are required two Hall generators which form an angle of 90° relative to one another. In addition to this relative complication, the system also has the disadvantage that the code can easily be made visible and readily changed, which in many cases is undesirable. Because of this, the system as a whole is not reliable enough.

Other lock-key combinations comprising a key having portions with variable magnetic permeability are described in Austrian Pat. No. 312 456 (Kibolac) and Swedish Pat. Nos. 403 160 (Åberg) and 319 998 (Sperry Rand). In all these systems there is a static sensing of the magnetic flux which requires as many sensing means as coded portions on the key. This makes these known systems rather complicated and accordingly expensive.

In U.S. Pat. No. 3,949,345 (Makino et al.) there is described a multiple magnetoresistance element not intended to cooperate with a lock and/or a key.

OBJECTS OF INVENTION

One object of the present invention is to provide a cylinder lock-key combination of the aforementioned kind with which the disadvantages associated with previously known similar combinations are eliminated and which is of simple and robust design and will not permit undesirable manipulation or actuation, and which is sufficiently reliable even after having been used for a relatively long time.

SUMMARY OF INVENTION

In its widest aspect a combination according to the invention is mainly characterized in that in the cylinder lock or the like is provided a magnetic body arranged to generate a magnetic flux which passes the key slot; that the coded information of the key is incorporated in locations of mutually different magnetic permeability which, with relative movement between the key and lock housing, cause variations in a magnetic flux; that the sensing means include, in an electronic circuit containing a bridge coupling and supplied with an operational voltage, means arranged to convert said magnetic flux variations to momentary resistance changes which cause the bridge coupling to be so unbalanced that there is generated in the circuit an electronic pulse train corresponding to the coded information; and in that connected to the circuit is a means, for example a data processing device, arranged to sense and evaluate said electronic pulse train.

Thus, an essential feature of the invention is that the coded information arranged on the key includes locations of different magnetic permeability. In this case, the permeability is a material constant which states the ability of the material in question to allow a magnetic flux to pass therethrough.

As is well known, magnetic material can be related to two major groups according to their magnetic and mechanical properties, namely soft magnetic and hard or permanent magnetic material. According to the type of material, it is usual to differentiate between metallic and ceramic material. At normal temperatures only five basic substances have magnetic properties, namely iron, nickel, cobalt, gadolineum and terbium. The alloys and oxides of these substances also have characteristic magnetic properties. It is surprising that manganese and aluminium, which itself lacks magnetic properties, provides a magnetic alloy together with silver. Ceramic magnetic material is produced mainly from mixtures of iron oxide and other metal oxides, of which the most common are so-called ferrites.

Soft magnetic material is characterized by a relatively high permeability. In addition to unalloyed iron certain iron-silici alloys and ferrites belong to this group. Hard or permanent magnetic material is characterized by low permeability. Binary, ternary and quaternary iron alloys, such as steel, can be used as permanent magnet materials. Permanent magnets may also be manufactured from metal oxides, of which the most common is barium ferrite.

Thus, the code of the key may include a soft magnetic material, such as non-alloyed iron alternating with locations of alloyed iron, such as steel.

Alternatively, in addition to locations of high magnetic permeability the code may include regions of another material exhibiting low magnetic permeability, for example a plastics material. As a further alternative the code may include regions which totally lack material of the aforementioned kind, i.e. incorporate air inclusions, and for this reason exhibit low magnetic permeability.

It is simple to devise the code of regions of the aforementioned kind in the key in a manner such that the code is hidden, i.e. that it is not possible to decide whether the key has any particular code or what code the key does have by simply studying said key. If, however, for some reason or other it is desirable for the code to be visible, this can readily be done by arranging the aforementioned differing locations or regions on the outer surface of the key and particularly on the outer surface of the key spine.

As opposed to the system described in the aforementioned German Open-to-public-print, Ser. No. 25 46 542, the intention with the present invention is therefore not that the actual key need include a magnetic means or material but only, as beforementioned, different areas of material having varying magnetic permeability. As will be understood from the aforegoing recitation of the various magnetic materials, the invention does not exclude the key from exhibiting one or more regions of magnetic material. A primary feature of the invention, however, is that the code exhibits locations of varying magnetic permeability—and not locations or regions which in themselves are able to generate a magnetic field or induction currents.

As beforementioned, the sensing means arranged in the housing shall also include means which are incorporated in an electronic circuit including a bridge coupling and supplied with an operational voltage and which are adopted to convert the variations in magnetic flux caused by said code to momentary changes in resistance. One such means known to the art which can be used for the purpose in question is a so-called differential field plate. This differential field plate is able to detect the difference between two magnetic fluxes and to convert the sensed differences to changes in resistance in an electric circuit. Thus, the field plate to which is passed the magnetic flux of the highest density obtains a higher electrical resistance and consequently is less electrically conductive than the other field plate which receives a reduced magnetic flux. The thus produced dissimilarity in electric conductivity is utilized in accordance with the invention to create an imbalance in an electric bridge coupling which is supplied with an operational voltage and in which balance prevails when both field plates are exposed to the same magnetic flux or when none of the field plates detects such a flux.

In this respect, the generated momentary changes in resistance will generate, by corresponding momentary imbalances caused in the bridge coupling, an electric pulse train corresponding to the coded information, which pulse train in turn can be detected and evaluated in a known manner, for example in a data processing device. Thus, as opposed to the aforementioned previously known system, the key in the system according to the present invention is passive insomuch as it does not primarily contribute to generating or creating a magnetic flux or an induction current, but merely, by exhibiting regions of varying magnetic permeability arranged in accordance with a predetermined pattern generates in the differential field plate connected with said regions or locations electrical resistance variations in dependence thereof, said variations being then utilized in the aforesaid manner via an electric bridge coupling.

For the purpose of achieving the function desired there can be provided in connection with the two field plates, in the read-out unit, pins which deflect and concentrate the similar or dissimilar magnetic fluxes resulting from the coded regions of the key. These pins may be arranged in a plate of suitable thickness associated with the field plate, so that the two pins are located closely adjacent the spine of the key when it is inserted into the lock housing. Further, the unit incorporating the differential field plate may, as a whole, be resiliently mounted in a recess in the housing, so that it lies against the key with a slight pressure when said key is inserted into the key slot. Leaf springs may be suitably used for this purpose.

As will be understood, a differential field plate having more than two pole shoes may be used, provided that the different regions incorporated in the information code on the key spine are arranged correspondingly.

In accordance with a preferred embodiment, the pattern of the coded regions of the key suitably include one or more L-shaped regions. In this way, the electronic evaluation circuit can readily decide whether the key moves into or out of the lock housing, and it is impossible to manipulate the security system by, for example, repeatedly inserting the key through shorter distances into the lock housing and then immediately withdrawing the key.

The invention also relates to a cylinder lock and to a key in a combination of the aforementioned kind, said lock and said key being mainly characterized by the features set forth in the following claims.

An exemplary embodiment of a combination according to the invention will now be described in more detail with reference to the accompanying schematic drawings.

DESCRIPTION OF PREFERRED EMBODIMENTS

Figure 1:
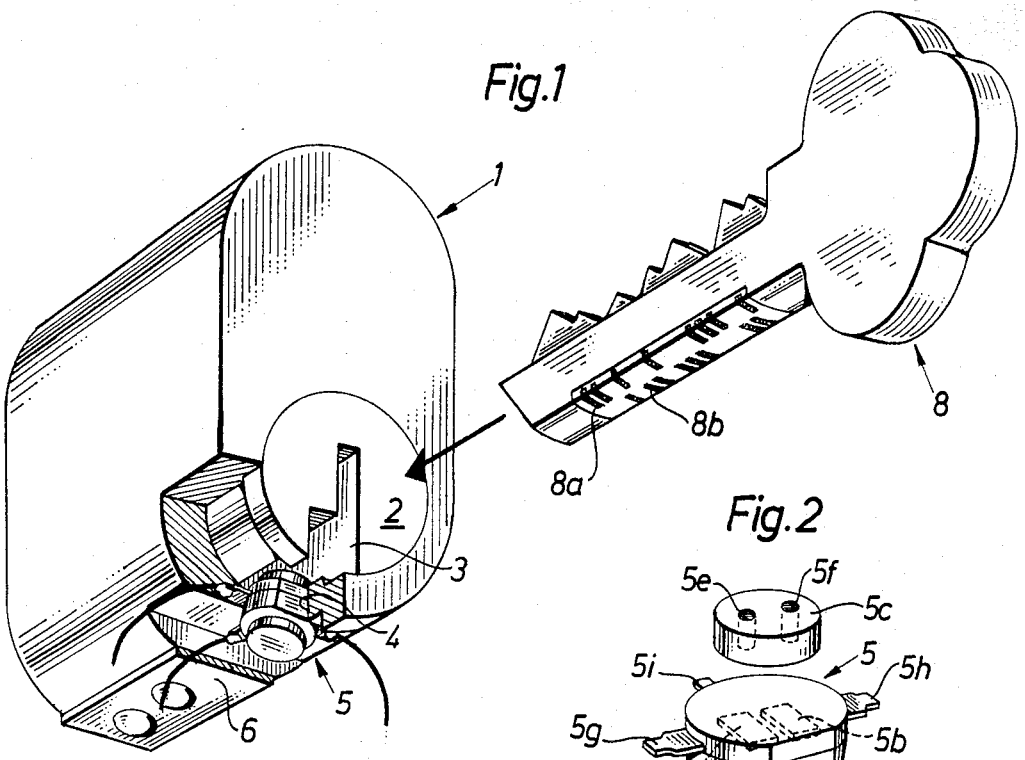
FIG. 1 is a perspective view of a cylinder lock according to the invention provided with a differential field plate; into which lock a key provided with coded information on the spine thereof can be inserted.
Figure 2:
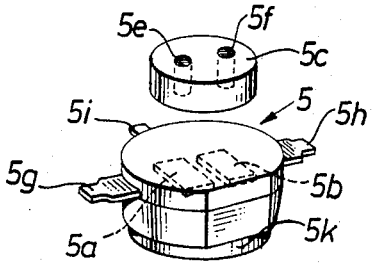
FIG. 2 is a perspective view of a differential plate incorporated in the lock housing illustrated in FIG. 1, and elements associated with said field plate.
Figure 3:
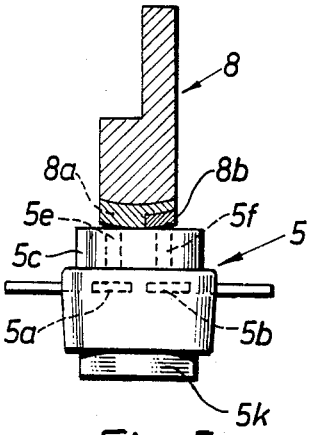
FIG. 3 is a front view of a differential field plate illustrated in FIG. 2, and a sectional view through a key while co-acting with said differential field plate.

With reference to FIG. 1, a cylinder lock-key combination comprises a lock housing 1 having a rotatable cylindrical plug 2 and a slot 3 for receiving a key 8. In the bottom part of the cylinder housing there is provided a recess 7 for receiving a differential field plate 5 mounted by means of leaf springs 6, the general construction of which field plate will be described hereinafter with reference to FIGS. 2 and 3.

Arranged on the spine of the key 8 is a coded information in the form of two rows 8*a*, 8*b* of regions of mutually different magnetic permeability arranged in a given pattern. By way of example, the key 8 may be made of brass, and the spine of the key may incorporate a plurality of rectangular regions of soft iron having a high magnetic permeability.

The differential field plate 5 incorporated in the lock housing, the major part of which plate has the form of a standard component exhibiting two field plates 5*a* and 5*b*, each of which is able to detect magnetic fluxes and, depending upon the difference between the magnitude of said fluxes, to generate varying resistances in an electric resistance incorporated in the field plate. To this end, the field plate has two electrical connections 5*g* and 5*h*, by which the plate can be connected into an electric circuit of the kind illustrated in FIG. 4. The field plate 5 is connected with a plate 5*c* having two parallel bores each of which accommodates a pole shoe 5*e* and 5*f*, respectively, said pole shoes being adapted to deflect and concentrate a magnetic flux generated by a magnetic body 5*k* and passing through the key slot 3.

When the differential field plate is arranged in the lock housing in the manner illustrated in FIG. 1, the pole shoes 5*e*, 5*f* will be pressed resiliently against the spine of the key while sensing the code comprising said regions 8*a*, 8*b*. (See FIG. 3).

Figure 4:
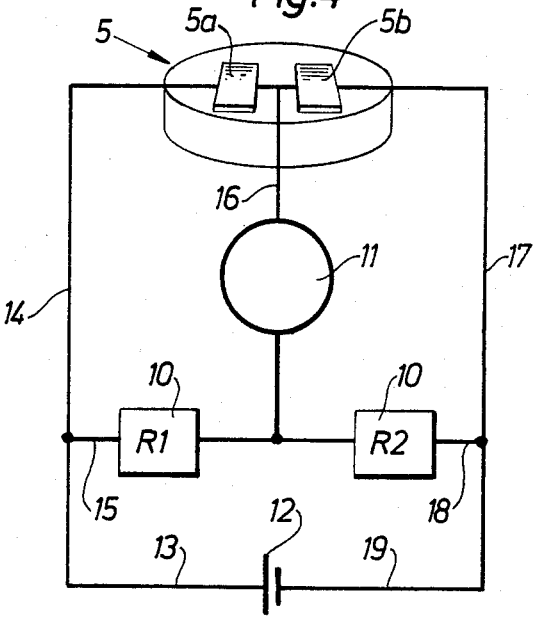
FIG. 4 is a basic diagram illustrating a bridge coupling which is supplied with an operational voltage and in which there is incorporated a differential field plate according to FIGS. 2 and 3.

FIG. 4 illustrates principally an electric circuit supplied with a drive voltage from a battery 12, said circuit incorporating a bridge coupling which includes two symmetrically arranged resistances 10 of mutually equal magnitude and the differential field plate 5. The differential field plate 5 incorporates two field plates 5*a* and 5*b* between which is connected a line 16 in which there is provided a sensing and evaluating element generally identified at 11 and which, for example, may comprise a data processing device. Since the two field plates 5*a*, 5*b* do not sense any magnetic flux or sense the same magnetic flux, there prevails a balance in the electric circuit, whereat no current passes through that part of the circuit which includes the line 16 and the evaluating means or data processing device 11. Since, however, one of the field plates 5*a*, 5*b* detects a greater magnetic flux than the other the electrical resistance in the field plate which detects the greatest magnetic flux will decrease, whereat the balance in the system will thus be disturbed. This means that the line 16 and the sensing means or data processing device 11 will deliver a current pulse of a given sense. If immediately thereafter balance again prevails in the system, said current pulse will cease. If thereafter the other field plate 5*b* senses a greater magnetic flux than the first plate 5*a*, the balance in the system will again be disturbed, this time such that the circuit 16, 11 will now be through passed by a current pulse in the opposite sense or direction.

By way of summary the sensing means or data processing device 11 will register an electric pulse train corresponding to the coded information of the key which is evaluated and registered by the data processing device. Thus, the data processing device can, for example, register at a given point of time that the lock in question has been opened by an authorized or an unauthorized person.

By using simple auxiliary devices it is possible herewith to arrange for example, that an attempt to open the lock by an unauthorized person fails. Alternatively, each attempt to open the lock can be registered in the data processing device so that it is possible subsequently to determine by means of which keys the attempts have been made and the times of such attempts.

Figure 5:
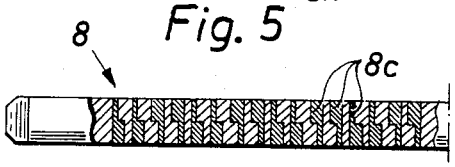
FIG. 5 is a bottom view which is partly cut of a key spine having a code comprising L-shaped portions.

Manipulation of the lock or the code on the spine of the key can easily be made impossible by giving one or more of the code regions of the key an L-shape. In FIG. 5 a number of such L-shaped code regions 8*c* are shown. The data processing device 11 can be readily programmed to determine how far the key has been inserted into the lock on each occassion, whereat any attempt to manipulate the lock or key will thus become the subject for particular registration by the data processing device.

L-shaped code regions 8*c* also facilitate for the data processing device to determine if the key has been inserted half way only and then—possibly repeatedly—withdrawn. If so a compensation therefore is made immediately. At the same time it will be registered what key—authorized or not—which has been inserted.

INDUSTRIAL APPLICABILITY

It will be understood that the basic concept of the invention can be applied in many different forms, and that the aforedescribed embodiment is merely an example. Thus, the magnetic body 5*k* may be arranged in a position different to that illustrated, for example externally of the lock housing itself or in the cylinder plug. Alternatively, a lock pin may simultaneously serve as a magnetic body for generating the requisite magnetic flux.

In the present specification "a rotatable cylinder plug" also refers to plugs being twistable or rotatable less than 360° in their cylinder housings.

We claim:

1. A cylinder lock-key combination comprising a cylinder housing (1) in which there is arranged a rotatable cylinder plug (2) having a key slot (3) for the key (8), and an electronic evaluating circuit (11–18) for establishing proper actuation of the cylinder, whereat the key (8) constitutes a carrier of coded information (8*a*, 8*b*) which can be read-off through a sensing means disposed proximate the cylinder housing and plug and connected to the electronic circuit, characterized in that arranged proximate the cylinder lock is a magnetic body (5*k*) arranged to generate a magnetic flux which passes the key slot (3);

that the coded information on the key (8) is incorporated at locations or regions (8*a*, 8*b*, 8*c*) of mutually different magnetic permeability and positioned one after the other in the longitudinal direction of the key, said locations or regions causing variations in said magnetic flux when the key is moved longitudinally relative to the housing;

that the sensing means includes means (5) incorporated in an electric circuit containing a bridge coupling and supplied with an operational voltage, said means (5) being arranged to convert said magnetic flux variations to momentary changes in resistance, said changes causing such imbalance of the bridge coupling that there is generated in said circuit an electric pulse train corresponding to said coded information; and that connected to the circuit is a means, for example a data processing device (11), arranged to sense and evaluate said pulse train.

2. A combination according to claim 1, characterized in that the sensing means comprises a magnetic differential field plate (5) arranged in said housing and having at least two pole shoes (5*e*, 5*f*) so situated that regions (8*a*, 8*b*, 8*c*) located on the spine of the key and having mutually different magnetic permeability pass at a small distance from said shoes when the key is inserted into the lock housing, said pole shoes having the form of pins (5*e*, 5*f*) arranged to concentrate and deflect magnetic flux to two field plates (5*a*, 5*b*).

3. A combination according to claim 2, characterized in that the differential field plate (5) is resiliently mounted in the lock housing in a manner such that the pole shoes (5*e*, 5*f*) of said plate (5) lie against the spine of said key with a slight pressure when the key is inserted.

4. A combination according to any one of claims 1–3, characterized in that one or more of the coded regions (8*c*) of the key is, or are, L-shaped.

5. A cylinder lock for the combination according to claim 1, including a cylinder housing (1) in which there is arranged a rotatable cylinder plug (2) having a slot (3) for a key (8) and an electronic evaluating circuit (11, 18) for establishing proper actuation of the cylinder, whereat the cylinder housing includes sensing means (5) connected to the electronic circuit, characterized in that the sensing means include a differential field plate (5) which is arranged in the housing (1) adjacent the key slot (3) and which is incorporated in an electric circuit having an electric bridge coupling and supplied with operational voltage, and which is arranged to convert magnetic flux variations generated when inserting the key to momentary resistance changes which cause corresponding momentary imbalance in the bridge coupling to form an electric pulse train.

6. A cylinder lock according to claim 5, characterized in that the cylinder housing (1) contains a magnetic body (5*k*) which is located at a relatively small distance from the key spine of the key slot (3) when the key is inserted.

7. A key for the combination according to claim 1, said key constituting a carrier of coded information (8*a*, 8*b*, 8*c*) which can be read-off by means of sensing means (11) connected to an electronic circuit and disposed proximate the cylinder housing and plug, characterized in that the coded information includes a pattern of locations or regions (8*a*, 8*b*, 8*c*) of varying magnetic permeability arranged on the spine of the key.

8. A key according to claim 7, characterized in that said pattern includes two parallel rows of said locations or regions (8*a*, 8*b*, 8*c*).

9. A key according to claims 7 or 8, characterized in that one or more of the locations or regions (8*c*) is or are L-shaped.

10. A key according to any one of claims 7–8, characterized in that said regions or locations (8*a*, 8*b*, 8*c*) are invisible from the outside of the key.

* * * * *